US007247104B2

(12) United States Patent
Poynor

(10) Patent No.: US 7,247,104 B2
(45) Date of Patent: Jul. 24, 2007

(54) COR ADJUSTMENT DEVICE

(75) Inventor: Raymond L. Poynor, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 204 days.

(21) Appl. No.: 10/992,073

(22) Filed: Nov. 19, 2004

(65) Prior Publication Data

US 2006/0111199 A1 May 25, 2006

(51) Int. Cl.
*A63B 53/04* (2006.01)

(52) U.S. Cl. ..... 473/329; 473/346

(58) Field of Classification Search ..... 473/329, 473/346, 244

See application file for complete search history.

(56) References Cited

U.S. PATENT DOCUMENTS 4,438,931 A * 3/1984 Motomiya ..... 473/346
4,511,145 A 4/1985 Schmidt
4,535,990 A 8/1985 Yamada
5,000,454 A 3/1991 Soda
5,346,213 A 9/1994 Yamada
5,380,010 A 1/1995 Werner et al.
5,451,058 A * 9/1995 Price et al. ..... 473/340
5,464,211 A 11/1995 Atkins et al.
5,586,948 A 12/1996 Mick
5,908,356 A * 6/1999 Nagamoto ..... 473/224
5,911,637 A 6/1999 Yamagata
5,941,782 A * 8/1999 Cook ..... 473/346
6,017,280 A 1/2000 Hubert
6,077,173 A 6/2000 Stites
6,165,081 A 12/2000 Chou
6,203,444 B1 * 3/2001 McRae ..... 473/244
6,299,547 B1 * 10/2001 Kosmatka ..... 473/329
6,354,961 B1 3/2002 Allen
6,524,194 B2 2/2003 McCabe
6,533,679 B1 3/2003 McCabe et al.
6,558,271 B1 5/2003 Beach et al.
6,595,057 B2 7/2003 Bissonnette et al.
6,605,007 B1 8/2003 Bissonnette et al.
6,669,576 B1 12/2003 Rice
6,672,975 B1 1/2004 Galloway
6,679,786 B2 1/2004 McCabe
6,743,117 B2 6/2004 Gilbert
7,056,229 B2 * 6/2006 Chen ..... 473/346
2003/0190975 A1 * 10/2003 Fagot ..... 473/346
2004/0204265 A1 10/2004 Chang
2006/0172818 A1 8/2006 Yamamoto

* cited by examiner

*Primary Examiner*—Sebastiano Passaniti
(74) *Attorney, Agent, or Firm*—Bingham McCutchen LLP

(57) ABSTRACT

A golf club head with a variable coefficient of restitution is disclosed and claimed. The club head includes a bias member that contacts and exerts a force against the interior surface of the face. The force exerted against the interior of the face lessens the face flexibility, and decreases the club head coefficient of restitution. The bias member can be adjusted from outside the club head, allowing the manufacturer to precisely adjust the club head coefficient of restitution.

13 Claims, 4 Drawing Sheets

COR ADJUSTMENT DEVICE

BACKGROUND OF THE INVENTION

1. Field of the Invention

The present invention relates to a golf club, and, more particularly, the present invention relates to a golf club with a coefficient of restitution adjustment device.

2. Description of the Related Art

Golf club heads come in many different forms and makes, such as wood- or metal-type, iron-type (including wedge-type club heads), utility- or specialty-type, and putter-type. Each of these styles has a prescribed function and make-up. The present invention relates to hollow golf club heads, such as wood-type and utility-type (generally referred to herein as wood-type golf clubs).

Wood-type type golf club heads generally include a front or striking face, a crown, a sole, and an arcuate skirt including a heel, a toe, and a back. The crown and skirt are sometimes referred to as a "shell." The front face interfaces with and strikes the golf ball. A plurality of grooves, sometimes referred to as "score lines," may be provided on the face to assist in imparting spin to the ball. The crown is generally configured to have a particular look to the golfer and to provide structural rigidity for the striking face. The sole of the golf club contacts and interacts with the ground during the swing.

The design and manufacture of wood-type golf clubs requires careful attention to club head construction. Among the many factors that must be considered are material selection, material treatment, structural integrity, and overall geometrical design. Exemplary geometrical design considerations include loft, lie, face angle, horizontal face bulge, vertical face roll, face size, sole curvature, center of gravity, and overall head weight. The interior design of the club head may be tailored to achieve particular characteristics, such as by including hosel or shaft attachment means, perimeter weighting on the face or body of the club head, and fillers within hollow club heads. Club heads typically are formed from stainless steel, aluminum, or titanium, and are cast, stamped as by forming sheet metal with pressure, forged, or formed by a combination of any two or more of these processes. The club heads may be formed from multiple pieces that are welded or otherwise joined together to form a hollow head, as is often the case of club heads designed with inserts, such as sole plates or crown plates. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

The distance a golf ball travels after impact with a golf club is dictated by the magnitude and direction of the ball's translational and rotational velocities. Golf ball travel distance is a function of the total kinetic energy imparted to the ball during impact with the club head, neglecting environmental effects. During impact, kinetic energy is transferred from the club and stored as elastic strain energy in the club head and the ball. After impact, the stored elastic energy is transformed back into kinetic energy in the form of translational and rotational velocity of the ball as well as of the club. Since the collision is not perfectly elastic, a portion of the energy is dissipated as heat, club head vibration, and viscoelastic relaxation of the ball. Golf ball landing accuracy also is driven by a number of factors. Some of these can be attributed to club head design. Of primary concern are center of gravity and club face flexibility.

Recently, in an effort to increase the golf ball travel distance, especially among amateur golfers, wood-type golf clubs with large head sizes have been introduced. The increased head size allows the club to possess a higher moment of inertia (MOI), which translates to a greater ability to resist club twisting resulting from off-center hits. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases. As the MOI increases, the stability, playability, and forgiveness of the club head increases.

The weights of these large club heads typically have been kept within acceptable limits by using lighter materials and thinner shell thicknesses. The club head faces also have been becoming steadily thinner. Thinner faces maximize the Coefficient of Restitution (COR), which means that the face will rebound more upon impact and impart more energy to the ball, thereby increasing shot length. A corollary to COR is contact time (CT), which is a measurement of the duration of the contact between the club face and the ball. CT increases and decreases as COR increases and decreases. The COR and CT of typical golf club heads are results of the club head design, particularly face thickness, and are not adjustable.

The United States Golf Association (USGA) and the Royal and Ancient Golf Club of St. Andrews (R&A), the governing bodies of golf, have instituted limitations upon the COR of golf clubs. It is important that club heads not exceed these limitations. Customized COR's may also be desired. For example, a particular player (such as a Tour player) may desire a specific COR under the USGA and R&A limits. Thus, what is needed is a golf club head with an adjustable COR.

SUMMARY OF THE INVENTION

The present invention is directed to a golf club with an adjustable COR and a device for adjusting a club head COR. The golf club head includes a body having a face, a sole, a crown, and a skirt. The face and sole define the club head loft angle. The golf club head also includes a bias member attached to an interior surface of the sole. The bias member includes an engagement member that is in contact with the interior surface of the face. A force is exerted against the face by the engagement member. The force exerted by the engagement member acts oppositely the force exerted against the face from striking a golf ball, and thus the engagement member limits the club head COR. The bias member also includes an adjustment member to vary the force exerted against the face by the engagement member, through which the club head COR can be adjusted. A retaining wall may be provided on the interior surface of the sole to contact the engagement member opposite the face, thereby bracing the engagement member. The retaining wall is positioned to contact the engagement member generally opposite the engagement member-face contact location. The adjustment member is positioned such that it is operatively accessible from outside the club head.

The bias member can be provided in a variety of designs. For example, the engagement member may contain an internal, threaded orifice and the adjustment member may include an outer surface at least a portion of which is threaded for operative engagement with the threaded orifice. With the engagement member constrained against rotational movement, rotation of the adjustment member causes a vertical displacement of the engagement member, changing the location at which the engagement member contacts the club face. As the contact location is adjusted vertically upwardly along the inwardly sloping face (due to the club head loft angle), the force exerted by the engagement member against the face interior surface increases. Increasing the force exerted against the interior surface of the club face decreases the flexibility of the club face and decreases the COR of the club head. The retaining wall may be configured to constrain the engagement member against rotational movement.

In another exemplary embodiment, the engagement member is again provided with an internal, threaded orifice and the adjustment is provided with an outer surface at least a portion of which is threaded for operative engagement with the threaded orifice. However, in this embodiment, the engagement member is constrained against vertical movement such that rotation of the adjustment member causes a rotational displacement of the engagement member. The engagement member is a cam and rotation thereof varies the force. The retaining wall may be configured to constrain the engagement member against vertical movement.

In another exemplary embodiment, the engagement member is rotatively coupled to the retaining wall. The adjustment member extends upward from the sole and contacts the engagement member, which is curved, a predetermined distance away from the retaining wall. Varying the extension of the adjustment member away from or toward the sole varies the rotation of the engagement member and varies the force exerted against the interior surface of the face, thus varying the club head COR.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft angles and others in the following portion of the specification may be read as if prefaced by the word "about" even though the term "about" may not expressly appear with the value, amount or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
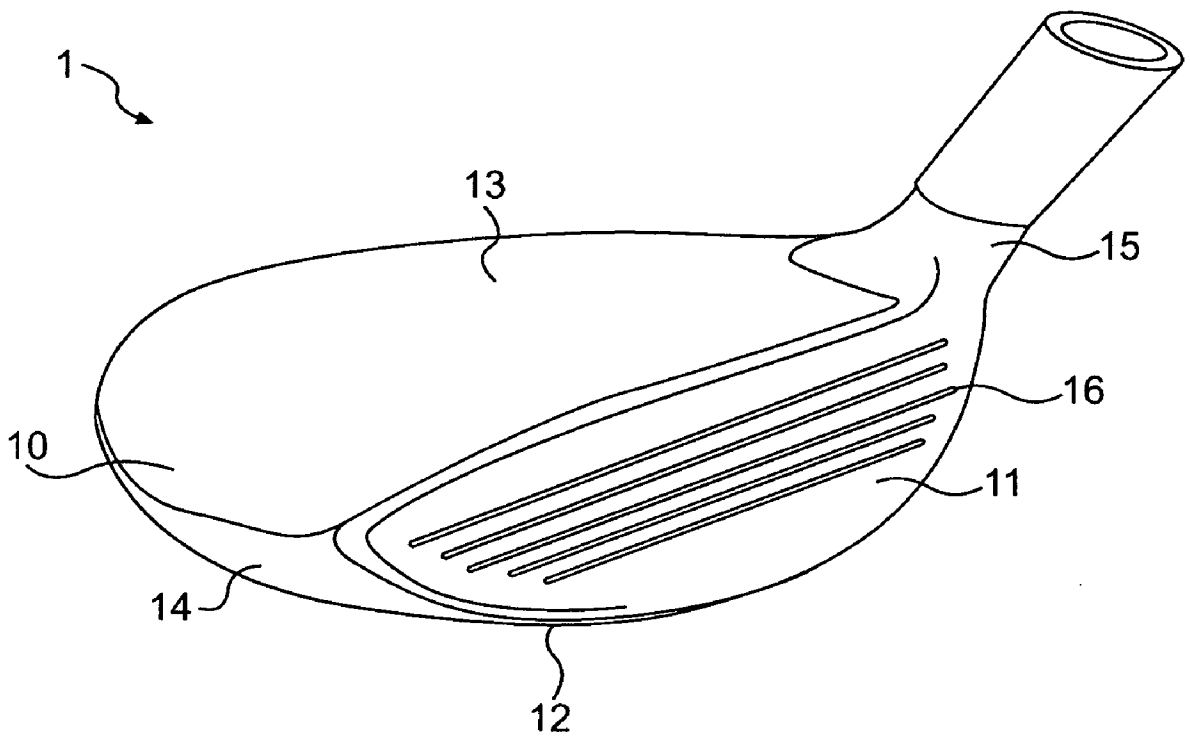
FIG. 1 shows a golf club head of the present invention.

FIG. 1 shows a wood-type golf club head 1 of the present invention. The club head 1 includes a body 10 having a face 11, a sole 12, a crown 13, a skirt 14, and a hosel 15. The body 10 defines a hollow, interior volume. Foam or other material may partially or completely fill the interior volume. The face 11 may be provided with grooves or score lines 16 therein of varying design.

COR is an important characteristic of golf clubs, especially wood-type golf clubs. As explained above, COR is a measure of the efficiency of the transfer of energy between two colliding bodies, in this case the golf club and the golf ball. As the efficiency of the energy transfer increases, the COR, the initial ball velocity, and the ball travel distance increase. During a golf shot, the club face and the golf ball deform upon impact. The club face can deform and then recover more efficiently than the ball can. Thus, the club face deformation and recovery can have a spring-like effect and impart more energy to the golf ball. As the amount of club face deformation increases, so do the club head COR and the forces applied to the ball.

The governing bodies of golf have defined a maximum COR value for "legal" golf clubs to be less than or equal to 0.83. Since manufacturing tolerances necessarily mean there will be some amount of variation, however small, among club heads of a particular design, golf club manufacturers may purposely design their club heads to have a lower COR than the maximum allowed. While this helps ensure that all of the club heads will comply with the applicable COR rules, it follows that the golfer will not achieve the maximum possible shot distance. Furthermore, since COR is inversely related to face thickness, golf club manufacturers are limited in the minimum thickness of club faces.

The present invention provides golf club manufacturers with more design freedom by allowing the club head COR to be adjusted and fine-tuned as a post-production step. A variable force is applied against the inner surface of the club face. This force limits the face deformation and, necessarily, the club head COR. Thus, golf club manufacturers can produce clubs with the maximum allowable COR. In fact, the manufacturers can produce a legal club head with a thinner face than previously possible. This allows redistribution of mass that would have been used in the face to other, more beneficial locations of the club head while maintaining a constant swing weight. For example, the designer may choose to relocate the mass to maximize the club head MOI. Furthermore, this allows the manufacturer to produce clubs with a consistent COR from club to club.

Figure 2:
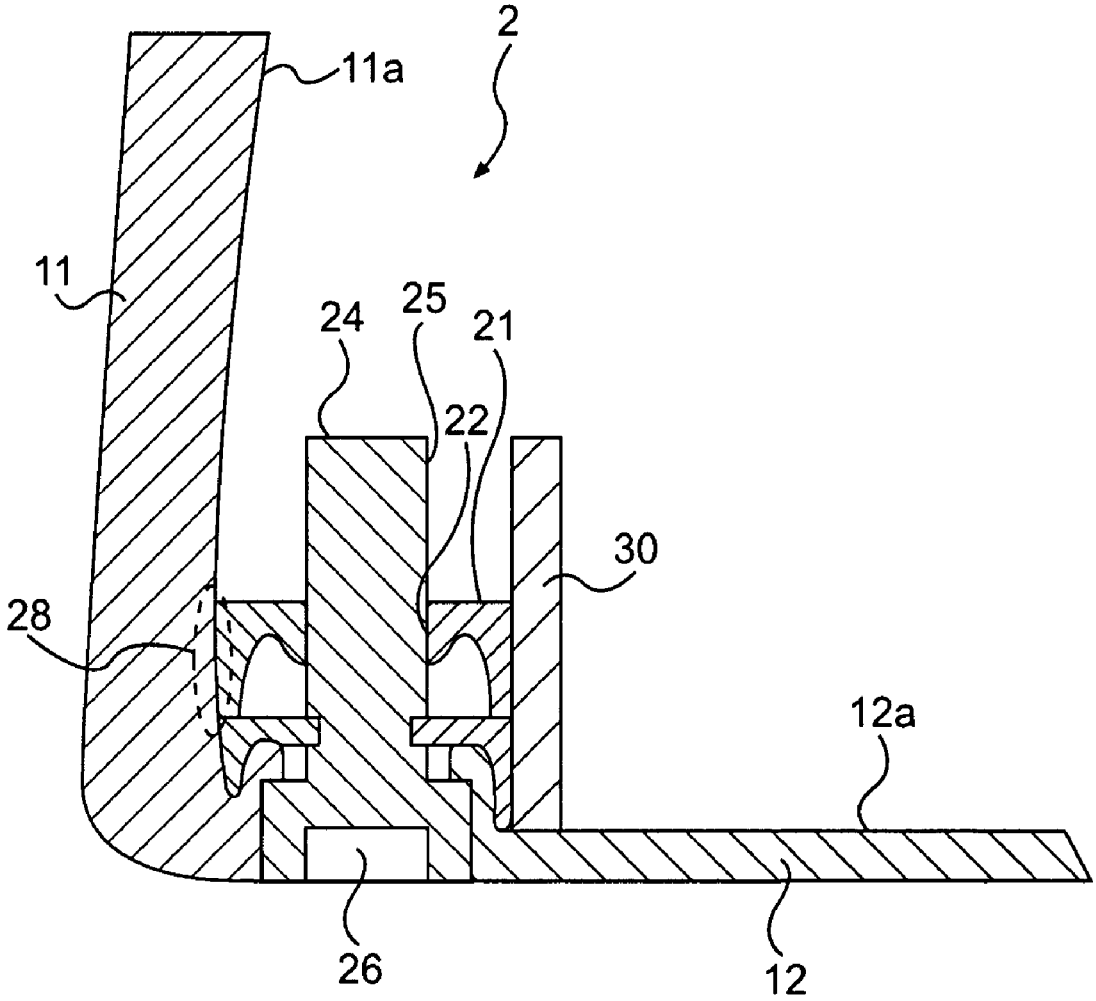
FIG. 2 shows a first coefficient of restitution adjustment device of the present invention in the club head of FIG. 1.
Figure 3:
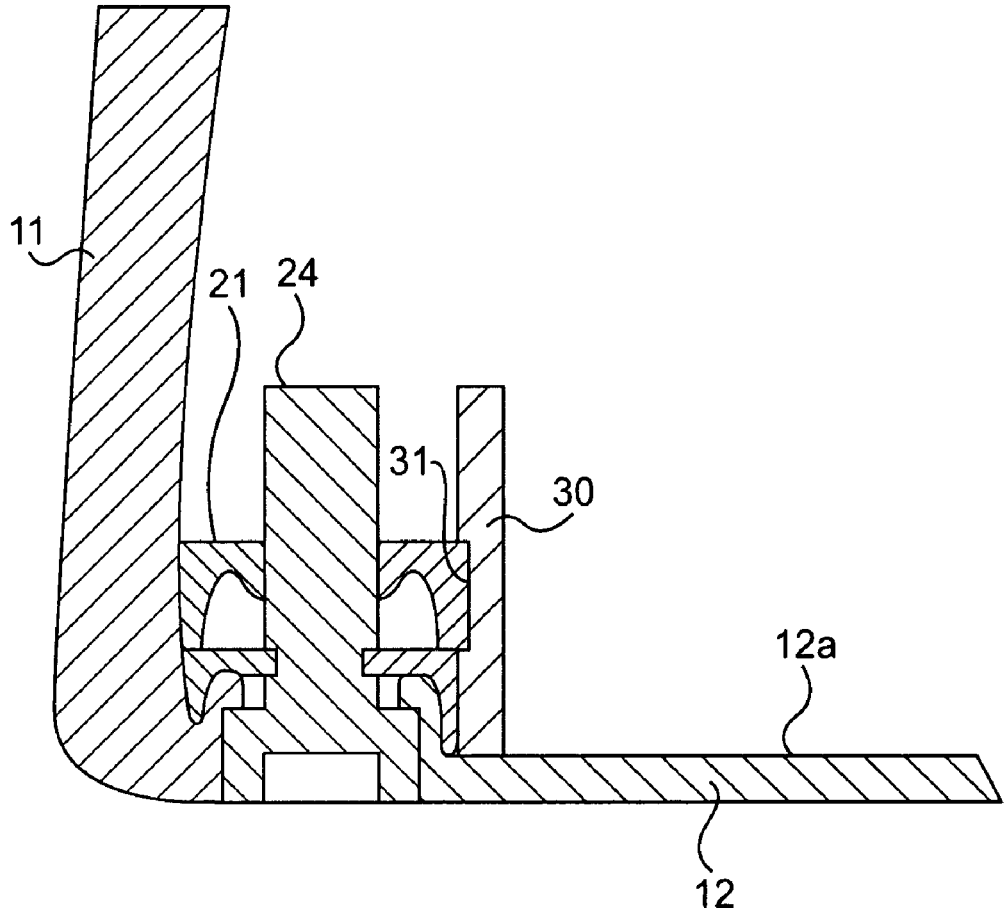
FIG. 3 shows a second coefficient of restitution adjustment device of the present invention in the club head of FIG. 1.

FIG. 2 shows a preferred embodiment of a COR adjustment device or bias member 2 in the club head 1. The club face 11 has an interior surface 11*a*, and the bias member 2 contacts the face interior surface 11*a* at a contact location 28, which preferably is located in the middle region of the face 11, and more preferably substantially equidistant from the toe and heel of the club head 1. The contact location 28 may be below the center of the face 11, above the center of the face 11, or at the center of the face 11. The bias member 2 exerts a force against the face interior surface 11*a*, the force acting substantially opposite the force imposed upon the club face 11 during impact with a golf ball. The force exerted by the bias member 2 against the face interior surface 11*a* results in reduced face flexibility, which reduces the COR and the CT of the face 11. Hence, as pressure on the face interior surface 11*a* is increased, the COR is reduced. The COR of the club head 1, therefore, is determined in part by the force exerted against the face interior surface 11*a* by the bias member 2.

The bias member 2 preferably is adjustable to exert a variable force against the face interior surface 11*a*, thereby varying the COR of the club head 1. By adjusting the bias member 2, a manufacturer or vendor can adjust and fine tune the club head COR. Thus, every club head produced can have the same COR value and the COR values can be controlled with greater accuracy than previously possible, resulting in a more consistent product from one club head to the next. Furthermore, this allows for adjustability from player to player as necessary. The bias member 2 allows the designer to create a club head 1 with a COR greater than 0.83, and then subsequently adjust the COR to be 0.83 or less.

In a first embodiment, the bias member 2 includes an engagement member 21 in contact with the face interior surface 11*a* at the contact location 28, and an adjustment member 24 operatively coupled to the engagement member 21. The engagement member 21 contains an internal, threaded orifice 22. The adjustment member 24 includes an outer surface 25 at least a portion of which is threaded for operative engagement with the threaded orifice 22 of the engagement member 21. The engagement member 21 is constrained against rotational movement such that rotation of the adjustment member 24 causes a vertical displacement of the engagement member 24, changing the contact location 28. The adjustment member 24 includes a portion 26 that may be engaged with a tool in known manner to rotate the adjustment member 24. For example, the engagement portion 26 may be shaped for mating engagement with a hex head wrench. Preferably, the adjustment member 21 is operatively accessible from outside the club head 1. The adjustment member 24 is captured or encapsulated in known fashion such that it is constrained against vertical movement. Therefore, rotation of the adjustment member 24 causes vertical displacement of the engagement member 21. As the engagement member 21 is raised, or moved toward the crown 13, the inwardly sloping face 11 (due to the club head loft angle) causes the engagement member 21 to exert increasing pressure against the face interior surface 11*a*. As explained above, increasing the force imparted by the engagement member 21 causes the COR of the club head 1 to decrease. Thus, raising the engagement member 21 decreases the COR of the club head 1. Similarly, as the engagement member 21 is lowered, or moved toward the sole 12, the force imparted to the face interior surface is decreased, and the COR of the club head 1 is increased.

The club head 1 may further include a retaining wall 30 coupled to and extending away from an interior surface 12*a* of the sole 12. The retaining wall 30 is positioned to contact the engagement member 21 generally opposite the contact location 28, thus imparting an equal and opposite force to the engagement member 21 as imparted by the club face 11. The bias member 2 is "wedged" between the face 11 and the retaining wall 30, providing a solid feel to the golf club.

The engagement member 21 may be constrained against rotational movement in a number of ways. One preferred method includes providing an engagement member 21 that is noncircular when viewed from above. The retaining wall 30 is contoured to matingly engage the noncircular profile of the engagement member 21, preventing rotation thereof. Rotational movement of the adjustment member 24 is converted to linear movement of the engagement member 21. The engagement member 21 may be provided in a variety of shapes and sizes.

In a second embodiment, the bias member 2 includes an engagement member 21, an adjustment member 24, and, optionally, a retaining wall 30 as in the first embodiment. In this embodiment, however, the engagement member 21 is constrained against vertical movement such that rotation of the adjustment member 24 causes a rotational displacement of the engagement member 24. The engagement member 21 is a cam, with an ellipse being a preferred cross-sectional shape. Alternatively, the engagement member 21 could be an eccentrically mounted circular disc. The cam causes the force imparted by the engagement member 21 to the face interior surface 11*a* to vary with the angular orientation of the bias member 2. The imparted force increases as the distance from an outer edge of the engagement member 21 to its center increases, causing the COR of the club head 1 to decrease. In this embodiment, the contact location 28 does not change. The threaded orifice 22 and threaded section 25 of the adjustment member 21 are not required for this embodiment, but may be useful in setting up the bias member 2 during manufacture of the club head 1.

The engagement member 21 may be constrained against vertical movement in a number of ways. One preferred method includes providing a groove 31 within the retaining wall 30. The engagement member 21 is seated within the groove 31, preventing it from vertical displacement. Rotational movement of the adjustment member 24 is converted to linear movement of the engagement member 21. Another preferred method includes fixedly coupling the engagement member 21 and the adjustment member 24, or providing them as one piece.

Figure 4:
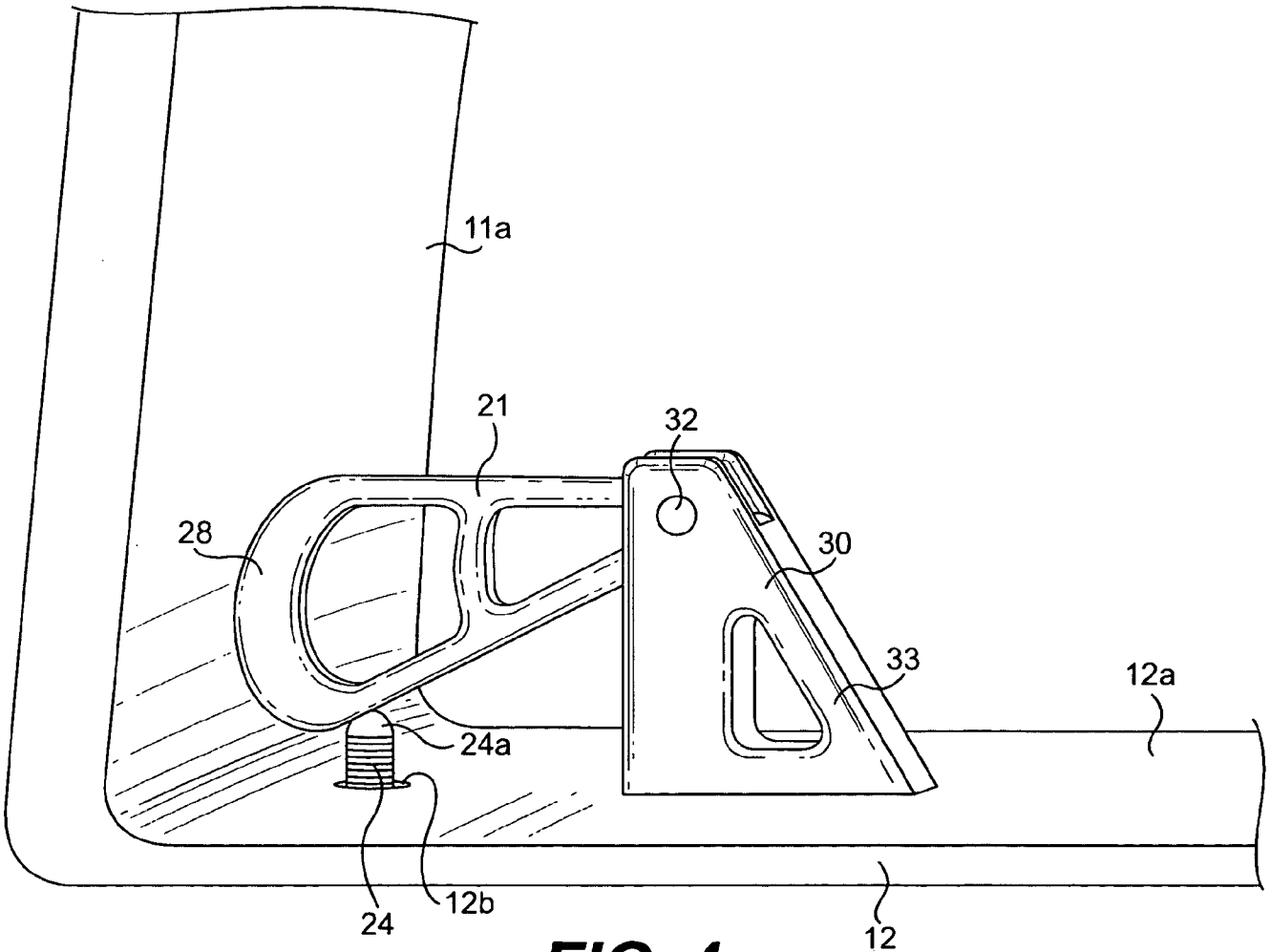
FIG. 4 shows a third coefficient of restitution adjustment device of the present invention in the club head of FIG. 1.

In a third embodiment, shown in FIG. 4, the bias member 2 includes an engagement member 21 in contact with the face interior surface 11*a* at the contact location 28, an adjustment member 24 in contact with the engagement member 21, and a retaining wall 30. The engagement member 21 is rotatively coupled to the retaining wall 30 such as via a pin 32. Preferably, one end of the engagement member 21 is coupled to the retaining wall 30 in cantilever fashion. The other end is curved, providing numerous points at which it may contact the face interior surface 11*a*. The sole 12 includes a threaded orifice 12*b*, with which the adjustment member 24 is operatively engaged. An inner end 24*a* of the adjustment member 24 contacts the engagement member 21. Due to the loft angle, the face 11 exerts pressure against the engagement member 21 that tends to force it downward into the adjustment member 24. Rotation of the adjustment member 24 results in vertical displacement thereof, causing rotation of the engagement member 21 about the pin 32. This rotation changes the contact location 28 on the face interior surface 11*a* and the force exerted thereagainst, as described above. The retaining wall 30 illustrated in FIG. 4 contains an angled leg 33 that helps to stabilize the wall 30 from the forced exerted against it be the engagement member 21.

The club head 1, including the COR adjustment device 2, may be manufactured or assembled in a variety of ways. One preferred method includes forming the shell of the club head with a face insert and/or crown insert, in known manner. The opening(s) in the shell for the insert(s) allows access to the interior volume of the club head 1. The sole 12 is provided with the retaining wall 30 already in place. The adjustment member 24 is then positioned, such as by feeding it upward through an opening in the sole 12 or lowering it from within the club head 1, with the engagement portion 26 being accessible from outside the club head 1. A clip or other device may be used to hold the adjustment member 24 in place. If the engagement member 21 is provided as a separate element from the adjustment member 24, it is then positioned in the desired location relative to the adjustment member 24. The insert(s) is then coupled to the club head shell, and any desired finishing steps are performed. It is important to note that this is merely one of a variety of manufacture/assembly procedures that can be employed. For example, the retaining wall could be coupled to the sole interior surface 12*a* after installing the COR adjustment device 2.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A golf club head, comprising:

a body including a face, a sole, a crown, and a skirt, said face and said sole defining a loft angle, said body defining an interior, said face including a face interior surface, and said sole including a sole interior surface; and a bias member coupled to said sole interior surface and in contact with said face interior surface at a contact location, said bias member exerting a force against said face interior surface, said bias member including an engagement member in contact with said face interior surface at said contact location and an adjustment member operatively coupled to said engagement member; wherein:

the club head has a coefficient of restitution determined in part by said force;

said bias member is adjustable to exert a variable force against said face interior surface, thereby varying said club head coefficient of restitution;

said engagement member contains an internal, threaded orifice;

said adjustment member includes an outer surface at least a portion of which is threaded for operative engagement with said threaded orifice; and said engagement member is constrained against rotational movement such that rotation of said adjustment member causes a vertical displacement of said engagement member, changing said contact location.

2. The golf club head of claim 1, further comprising a retaining wall coupled to and extending away from said sole interior surface, said retaining wall positioned to engage said engagement member generally opposite said contact location.

3. The golf club head of claim 2, wherein said retaining wall is configured to constrain said engagement member against rotational movement.

4. The golf club head of claim 1, wherein said adjustment member is captured such that it is constrained against vertical movement.

5. A golf club head, comprising:

a body including a face, a sole, a crown, and a skirt, said face and said sole defining a loft angle, said body defining an interior, said face including a face interior surface, and said sole including a sole interior surface; and a bias member coupled to said sole interior surface and in contact with said face interior surface at a contact location, said bias member exerting a force against said face interior surface, said bias member including an engagement member in contact with said face interior surface at said contact location and an adjustment member operatively coupled to said engagement member; wherein:

the club head has a coefficient of restitution determined in part by said force;

said bias member is adjustable to exert a variable force against said face interior surface, thereby varying said club head coefficient of restitution; and said engagement member is constrained against vertical movement such that rotation of said adjustment member causes a rotational displacement of said engagement member.

6. The golf club head of claim 5, wherein said engagement member is a cam and rotation thereof varies said force.

7. The golf club head of claim 6, further comprising a retaining wall coupled to and extending away from said sole interior surface, said retaining wall positioned to engage said engagement member generally opposite said contact location.

8. The golf club head of claim 7, wherein said retaining wall is configured to constrain said engagement member against vertical movement.

9. The golf club head of claim 8, wherein said adjustment member is captured such that it is constrained against vertical movement.

10. A golf club head, comprising:

a body including a face, a sole, a crown, and a skirt, said face and said sole defining a loft angle, said body defining an interior, said face including a face interior surface, and said sole including a sole interior surface;

a bias member coupled to said sole interior surface and in contact with said face interior surface at a contact location, said bias member exerting a force against said face interior surface, said bias member including an engagement member in contact with said face interior surface at said contact location and an adjustment member operatively coupled to said engagement member; and a retaining wall; wherein:

the club head has a coefficient of restitution determined in part by said force;

said bias member is adjustable to exert a variable force against said face interior surface, thereby varying said club head coefficient of restitution; and said engagement member is rotatively coupled to said retaining wall.

11. The golf club head of claim 10, wherein said engagement member is curved and rotation thereof varies said force.

12. A golf club head, comprising:

a body including a face, a sole, a crown, and a skirt, said face and said sole defining a loft angle, said body defining an interior, said face including a face interior surface, and said sole including a sole interior surface; and a bias member adjustably coupled to said sole interior surface and in contact with said face interior surface at a contact location, said bias member exerting a force against said face interior surface, said bias member including an engagement member in contact with said face interior surface at said contact location and an adjustment member operatively coupled to said engagement member; wherein:

the club head has a coefficient of restitution determined in part by said force;

said bias member is adjustable to exert a variable force against said face interior surface, thereby varying said club head coefficient of restitution; and said adjustment member is operatively accessible from outside the club head.

13. The golf club head of claim 12, wherein said adjustment member is captured such that it is constrained against vertical movement.

* * * * *